US007891783B2

(12) United States Patent
Tsuda

(10) Patent No.: US 7,891,783 B2
(45) Date of Patent: Feb. 22, 2011

(54) LIQUID JET HEAD AND A LIQUID JET APPARATUS

(75) Inventor: Akihito Tsuda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 129 days.

(21) Appl. No.: 12/371,258

(22) Filed: Feb. 13, 2009

(65) Prior Publication Data

US 2009/0207213 A1 Aug. 20, 2009

(30) Foreign Application Priority Data

Feb. 14, 2008 (JP) ..... 2008-032796

(51) Int. Cl.
*B41J 2/045* (2006.01)

(52) U.S. Cl. ..... 347/70

(58) Field of Classification Search ..... 347/70, 347/71

See application file for complete search history.

(56) References Cited

U.S. PATENT DOCUMENTS

2006/0250456 A1* 11/2006 Matsuzawa et al. ..... 347/68

FOREIGN PATENT DOCUMENTS

WO 2005/028207 A1 3/2005

* cited by examiner

*Primary Examiner*—K. Feggins
*Assistant Examiner*—Lisa M Solomon
(74) *Attorney, Agent, or Firm*—Workman Nydegger

(57) ABSTRACT

Provided is a liquid jet head including: a flow path forming substrate having formed therein a row of pressure generating chambers, each of which is communicated with a nozzle opening; a piezoelectric element which is provided in each of the pressure generating chambers via a vibration plate formed of a plurality of layers; and a bonding substrate which is bonded to a piezoelectric element forming side of the flow path forming substrate, in which: a groove is formed in a region of the vibration plate surrounding the piezoelectric element so as to extend to an interface of the plurality of layers or extend over the interface; and an insulator formed of an inorganic insulating material is formed in the groove.

5 Claims, 7 Drawing Sheets

LIQUID JET HEAD AND A LIQUID JET APPARATUS

CROSS REFERENCES TO RELATED APPLICATIONS

The present invention contains subject matter related to Japanese Patent Application No. 2008-032796 filed in the Japanese Patent Office on Feb. 14, 2008, the entire contents of which are incorporated herein by reference.

BACKGROUND OF THE INVENTION

1. Field of the Invention

The present invention relates to a liquid jet head and a liquid jet apparatus.

2. Description of the Related Art

The present invention relates to a liquid jet head and a liquid jet apparatus. More particularly, the present invention relates to an ink jet recording head and an ink jet recording apparatus in which a vibration plate is formed by a portion of a pressure generating chamber which is communicated with a nozzle opening ejecting ink droplets therefrom, and a piezoelectric element is formed on a surface of the vibration plate so that the ink droplets are ejected by the displacement of the piezoelectric element.

As the ink jet recording head, a structure having a flow path forming substrate which has formed therein at least two rows of pressure generating chambers communicated with nozzle openings and a bonding substrate which is bonded to the flow path forming substrate at a side where piezoelectric elements are formed and on which a driving IC for driving the piezoelectric elements is mounted is known.

In such an ink jet recording head, a configuration is known in which the vibration plate consists of a silicon oxide layer and a zirconium oxide layer and the piezoelectric element consists of a lower electrode, a piezoelectric layer, and an upper electrode. Further, a configuration is known in which a pattern region of the layers constituting the piezoelectric element is covered with an insulating protective film formed of an inorganic insulating material.

When moisture contained in ink or the like enters into an interface of the silicon oxide layer and the zirconium oxide layer, the interface peels off to destroy the vibration plate, so that the performance of the vibration plate deteriorates.

Such problems are similarly found in other liquid jet heads ejecting droplets of different liquid other than ink as well as the ink jet recording head ejecting ink droplets.

SUMMARY OF THE INVENTION

Therefore, the present invention is implemented to solve at least a part of the above-described problems and can be actualized as a form or an application described below.

The present invention is implemented to solve at least a part of the above-described problems and can be actualized as a form or an application described below.

A liquid jet head comprises: a flow path forming substrate having formed therein a row of pressure generating chambers, each of which is communicated with a nozzle opening; a piezoelectric element which is provided in each of the pressure generating chambers via a vibration plate formed of a plurality of layers; and a bonding substrate which is bonded to a side of the flow path forming substrate close to the piezoelectric element, wherein a groove is formed in a region of the vibration plate surrounding the piezoelectric element so as to extend to an interface of the plurality of layers or extend over the interface, wherein an insulator formed of an inorganic insulating material is formed in the groove.

Other features and objects of the present invention other than the above-mentioned ones will become clear by reading the description of the present specification with reference to the accompanying drawings.

BRIEF DESCRIPTION OF THE DRAWINGS

For more complete understanding of the present invention and the advantages thereof, reference is now made to the following description taken in conjunction with the accompanying drawings, in which.

DETAILED DESCRIPTION OF THE PREFERRED EMBODIMENTS

Figure 1:
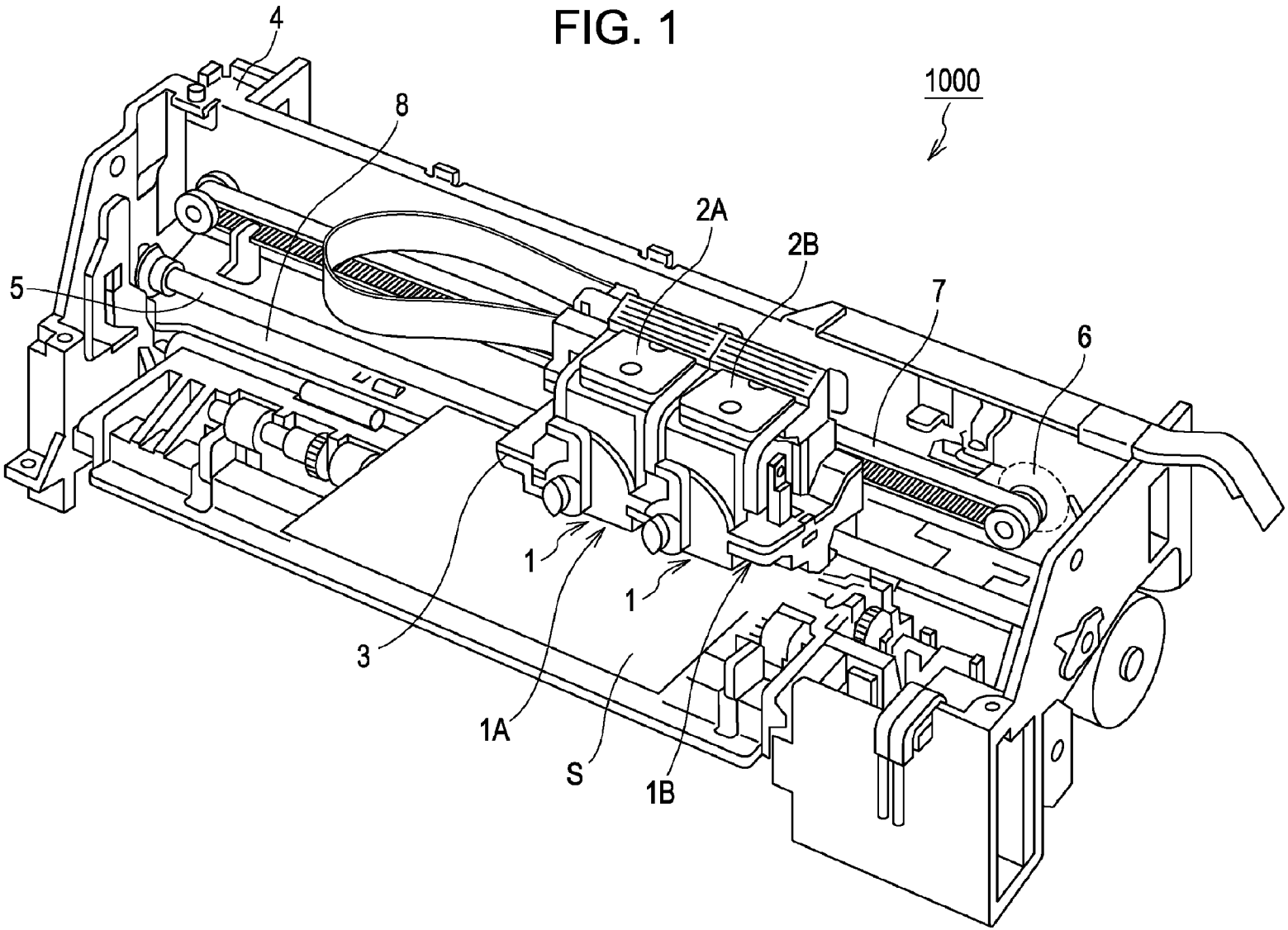
FIG. 1 is a schematic view showing an example of an ink jet recording apparatus as a liquid jet apparatus according to a first embodiment.

At least the following matters will be made clear by the explanation in the present specification and the description of the accompanying drawings.

A liquid jet head characterized in that it comprises: a flow path forming substrate having formed therein a row of pressure generating chambers, each of which is communicated with a nozzle opening; a piezoelectric element which is provided in each of the pressure generating chambers via a vibration plate formed of a plurality of layers; and a bonding substrate which is bonded to a side of the flow path forming substrate close to the piezoelectric element, wherein a groove is formed in a region of the vibration plate surrounding the piezoelectric element so as to extend to an interface of the plurality of layers or extend over the interface, wherein an insulator formed of an inorganic insulating material is formed in the groove.

According to this application, the groove is formed in the region of the vibration plate surrounding the piezoelectric element so as to extend to the interface of the plurality of layers of the vibration plate. Since the insulator is formed in the groove, the insulator is formed so as to cover the interface. Therefore, moisture moving toward the piezoelectric element from an outside of the groove through the interface of the layers of the vibration plate is blocked by the insulator, decreasing the possibility of the vibration plate to be destroyed by the moisture entering into the interlayer of the vibration plate where the piezoelectric element is formed, whereby a highly reliable liquid jet head can be obtained.

The liquid jet head is characterized in that the groove is formed in a region of the vibration plate surrounding the pressure generating chambers.

In this application, although the piezoelectric element is supported by the vibration plate with respect to the pressure generating chambers, the groove is formed in the vibration plate so as not to interfere with the pressure generating chambers. Therefore, the possibility of the vibration plate to be destroyed from the narrowed portion because of the groove formed therein decreases, and it is thus possible to obtain a highly reliable liquid jet head.

The liquid jet head is characterized in that the inorganic insulating material comprises aluminum oxide.

In this application, since aluminum oxide, particularly, having very low moisture permeability among the inorganic insulating materials is formed so as to cover the interface of the layers of the vibration plate, the possibility of moisture to enter into the interlayer of the vibration plate where the piezoelectric element is formed is further decreased. Therefore, the possibility of the vibration plate to be destroyed at a portion where the piezoelectric element is formed is decreased, and it is thus possible to obtain a liquid jet head having a higher reliability.

The liquid jet head is characterized in that the vibration plate comprises two layers, one layer of the two layers comprising silicon oxide and the other layer comprising zirconium oxide.

In this application, moisture is prevented from entering into an interface of the layer comprising silicon oxide which peels off easily due to entry of moisture and the layer comprising zirconium oxide, decreasing the possibility of the vibration plate to be destroyed by the moisture entering into the interlayer of the vibration plate, whereby a highly reliable liquid jet head can be obtained.

A liquid jet apparatus characterized in that it comprises the liquid jet head.

According to this application, it is possible to obtain a liquid jet apparatus capable of achieving the above-mentioned advantages.

Preferred embodiments of the present invention will be described with reference to the accompanying drawings. It should be noted that the embodiments described below is described as an example of the present invention and that not all of the constructions described therein are indispensable constituent elements of the present invention.

PREFERRED EMBODIMENTS

Hereinafter, embodiments will be described with reference to the drawings.

First Embodiment

FIG. 1 is a schematic view showing an example of an ink jet recording apparatus 1000 as a liquid jet apparatus according to the present embodiment.

As shown in FIG. 1, the ink jet recording apparatus 1000 includes recording head units 1A and 1B.

The recording head units 1A and 1B are provided with cartridges 2A and 2B which constitute an ink supply unit and are detachably attached thereto, respectively. A carriage 3 having the recording head units 1A and 1B mounted thereon is provided on a carriage shaft 5 attached to an apparatus body 4 so as to be movable in an axial direction of the carriage shaft 5.

The recording head units 1A and 1B are configured to eject, for example, black ink composition and color ink composition, respectively. When a driving force of a driving motor 6 is transferred to the carriage 3 via a plurality of non-illustrated gears and a timing belt 7, the carriage 3 mounting thereon the recording head units 1A and 1B is moved along the carriage shaft 5. On the other hand, a platen 8 is provided to the apparatus body 4 along the carriage shaft 5 so that a recording sheet S which is a recording medium such as paper fed by a non-illustrated feed roller or the like is transported on the platen 8.

The recording head units 1A and 1B are provided with ink jet recording heads 1 as liquid jet heads at positions opposed to the recording sheet S.

Figure 2:
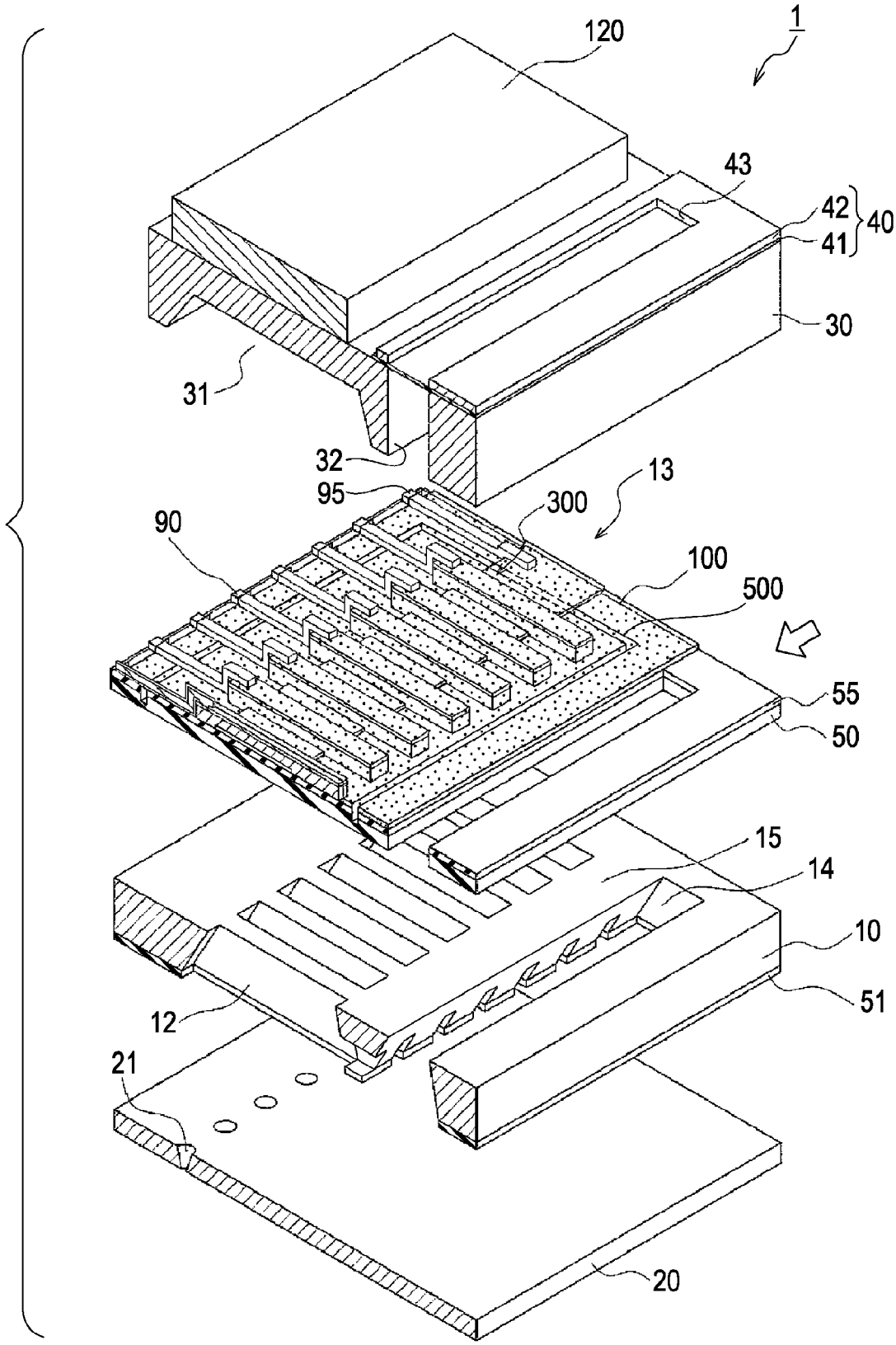
FIG. 2 is a partially exploded perspective view of an ink jet recording head.

Referring to FIG. 2, a partially exploded perspective view showing the ink jet recording head 1 according to the present embodiment is shown. The ink jet recording head 1 has an approximately rectangular shape, and FIG. 2 is a partially exploded perspective view of the ink jet recording head 1, cut along planes perpendicular to a longitudinal direction thereof (the direction of an outlined arrow in the drawing).

FIG. 3A is a partial top plan view of the ink jet recording head 1, and FIG. 3B is an A-A sectional view thereof.

Figure 3:
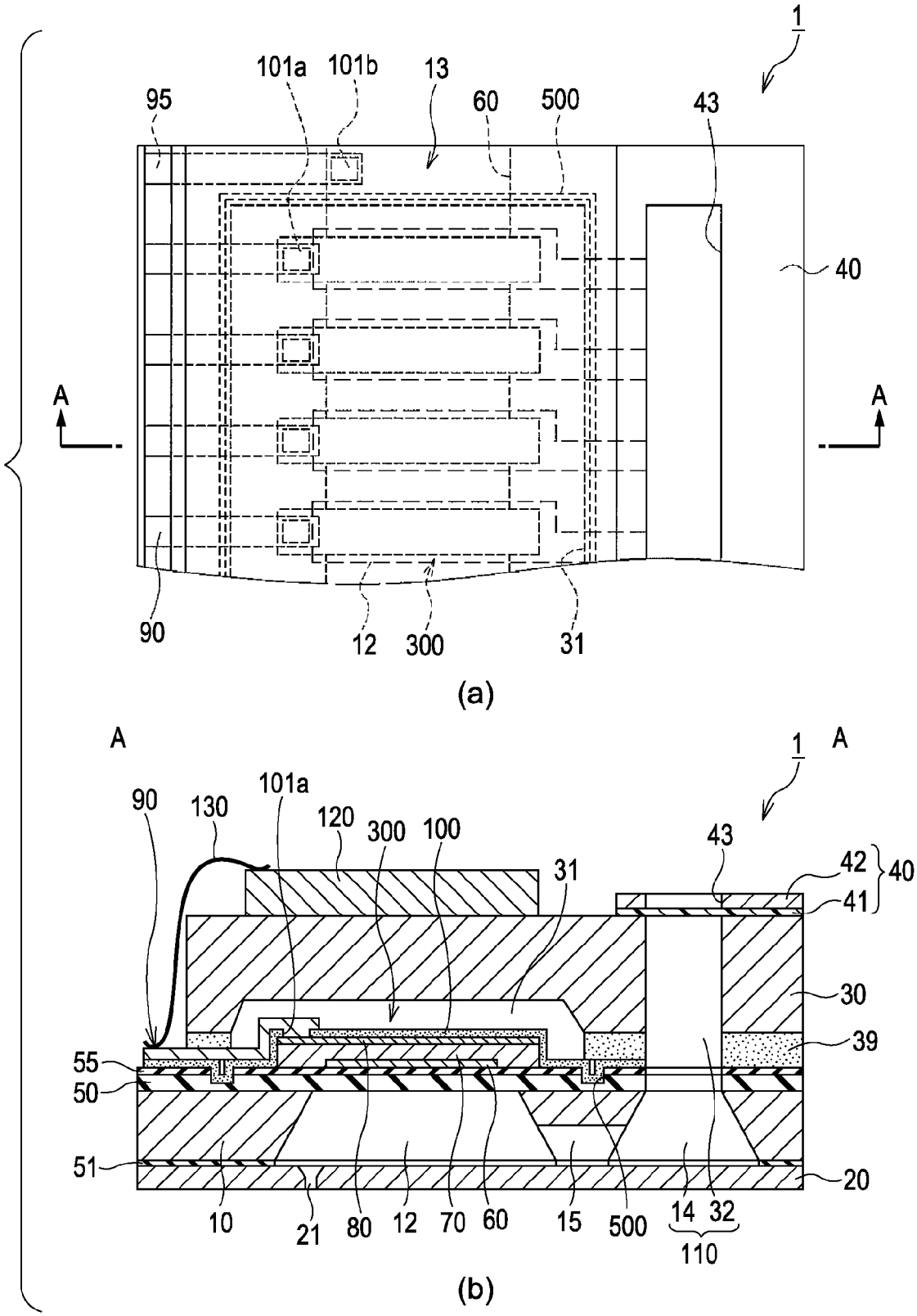
FIG. 3A is a partial top plan view of the ink jet recording head.
FIG. 3B is an A-A sectional view thereof.

In FIGS. 2 and 3, the ink jet recording head 1 is provided with a flow path forming substrate 10, a nozzle plate 20, a bonding substrate 30, a compliance substrate 40, and a driving IC 120.

The flow path forming substrate 10, the nozzle plate 20, and the bonding substrate 30 are stacked so that the flow path forming substrate 10 is sandwiched between the nozzle plate 20 and the bonding substrate 30, and the compliance substrate 40 is formed on the bonding substrate 30. The driving IC 120 is mounted on the compliance substrate 40.

The flow path forming substrate 10 is formed of a single crystal silicon substrate which has a plane (110) of the plane orientation. In the flow path forming substrate 10, a plurality of pressure generating chambers 12 is formed by anisotropic etching so as to form a row 13. The pressure generating chambers 12 have a trapezoidal shape in sectional view taken along a direction perpendicular to the longitudinal direction of the ink jet recording head 1, and the pressure generating chambers 12 are formed so as to extend long in the width direction of the ink jet recording head 1.

The flow path forming substrate 10 is formed with an ink supply path 14 at one end thereof in the width direction of each of the pressure generating chambers 12. The ink supply paths 14 and the pressure generating chambers 12 are communicated with each other via a communicating portion 15 which is provided for each of the pressure generating chambers 12. The communicating portion 15 is formed with a width narrower than that of the pressure generating chamber 12, and is configured to keep constant flow path resistance of ink flowing from the communicating portion 15 into the pressure generating chambers 12.

The nozzle plate 20 has nozzle openings 21 bored therein which are communicated with a zone near the end portions of the pressure generating chambers 12 on the side opposite to the liquid supply paths 14.

The nozzle plate 20 is formed of a glass ceramic, a single crystal silicon substrate, or stainless steel having a thickness of, for example, 0.01 to 1 mm, and a linear expansion coefficient of, for example, 2.5 to 4.5 [$\times 10^{-6}/\square$] at 300□ or below.

The flow path forming substrate 10 and the nozzle plate 20 are fixedly secured to each other by an adhesive or a heat welding film via an insulating protective film 51 which is used as a mask when forming the pressure generating chambers 12 by anisotropic etching.

On a surface of the flow path forming substrate 10 opposed to the surface thereof where the nozzle plate 20 is fixedly secured, an elastic film 50 as a vibration plate is formed. The elastic film 50 is formed of an oxide film which is formed by thermal oxidation.

An insulation film 55 formed of an oxide film is formed on the elastic film 50 of the flow path forming substrate 10. Moreover, a lower electrode film 60 formed of metal such as platinum (Pt) or metal oxides such as strontium ruthenium oxide (SrRuO), a piezoelectric layer 70 with the Perovskite structure, and an upper electrode film 80 formed of metal such as Au or Ir are formed on the insulation film 55, thereby constituting a piezoelectric element 300. The piezoelectric element 300 refers to a portion including the lower electrode film 60, the piezoelectric layer 70, and the upper electrode film 80.

The material for the piezoelectric layer 70 is, for example, a ferroelectric piezoelectric material such as lead zirconate titanate (PZT), or a relaxor ferroelectric material having a metal, such as niobium, nickel, magnesium, bismuth or yttrium, added to such a ferroelectric piezoelectric material. The composition of the piezoelectric layer 70 may be chosen, as appropriate, in consideration of the characteristics, uses, and the like of the piezoelectric elements 300.

Generally, one of the electrodes of the piezoelectric element 300 is used as a common electrode, and the other electrode and the piezoelectric layer 70 are patterned to be constructed for each of the pressure generating chambers 12. A portion, which is composed of any one of the electrodes and the piezoelectric layer 70 that have been patterned, and which undergoes piezoelectric distortion upon application of voltage to both electrodes, is called a piezoelectric active portion.

In the present embodiment, the lower electrode film 60 is used as the common electrode for the piezoelectric elements 300, while the upper electrode film 80 is used as an individual electrode of each of the piezoelectric elements 300. However, there is no harm in reversing their usages for the convenience of the drive circuit or wiring. In either case, the piezoelectric active portion is formed for each of the pressure generating chambers 12. Herein, the piezoelectric elements 300, and the elastic film 50 and the insulation film 55 (these two films are collectively referred to as a vibration plate), where displacement occurs by the driving of the piezoelectric elements 300, are referred to collectively as a piezoelectric actuator.

In FIGS. 2 and 3, an insulating protective film 100 as an insulator is formed so as to cover the piezoelectric elements 300. Moreover, a groove 500 is formed so as to surround the plurality of piezoelectric elements 300 and the pressure generating chambers 12, and the insulating protective film 100 is formed so as to be buried in the groove 500 which is formed in the insulation film 55 and the elastic film 50.

Figure 4:
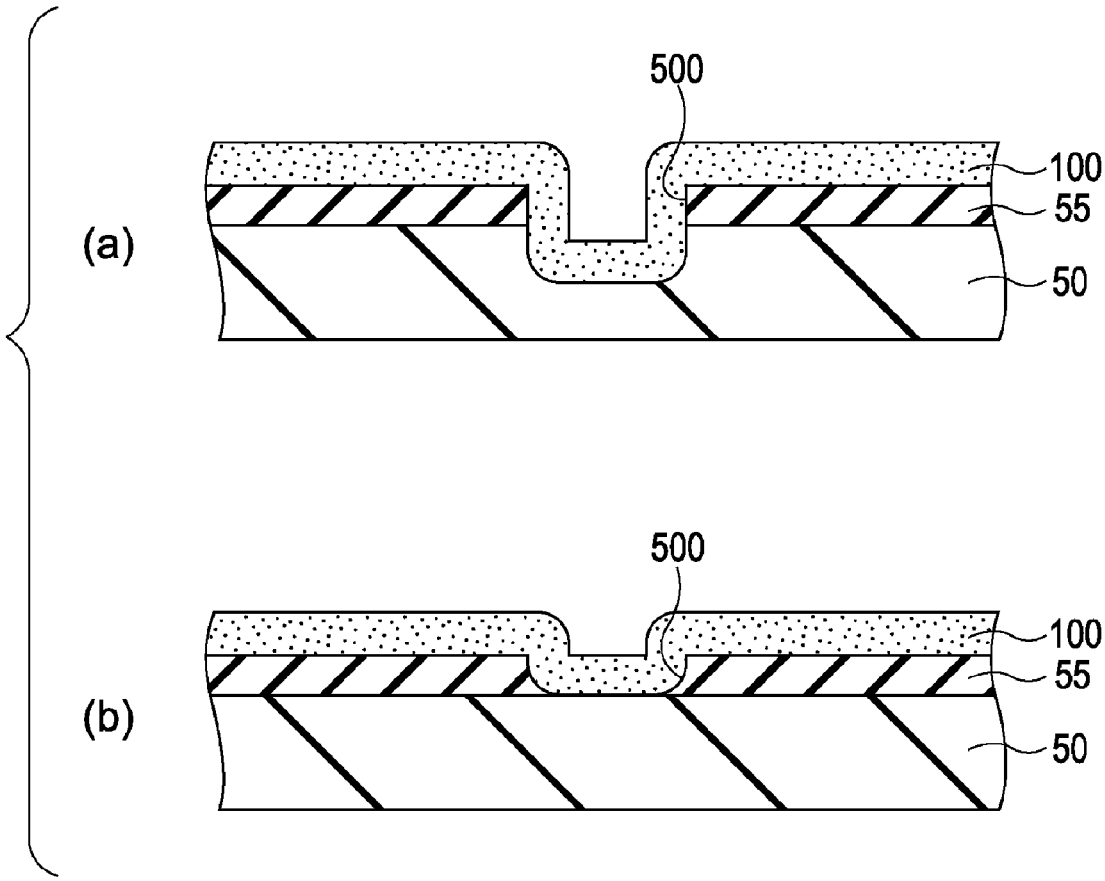
FIG. 4 is an enlarged sectional view showing the vicinity of a groove.

Referring to FIG. 4, an enlarged sectional view showing the vicinity of the groove 500 is shown. FIG. 4A shows a state where the groove 500 is formed to extend to the elastic film 50, and FIG. 4B shows a state where the groove 500 is formed in the insulation film 55.

The insulating protective film 100 is formed in the groove 500. Although the insulating protective film 100 is depicted to have the same thickness in FIG. 4, the insulating protective film 100 may have a different thickness in a portion thereof corresponding to the groove 500. Moreover, the groove 500 may be buried in the insulating protective film 100.

The interface of the elastic film 50 and the insulation film 55 may be covered by forming the insulating protective film 100 in the groove 500.

The groove 500 can be formed by etching the insulation film 55 and the elastic film 50 while masking the portions thereof where the groove 500 is not formed.

The material for the insulating protective film 100 is not particularly limited as long as it is an inorganic insulating material, and its example includes aluminum oxide ($AlO_x$), tantalum oxide ($TaO_x$), and the like.

The insulating protective film 100 is formed, for example, by the CVD process or the like. Moreover, by appropriately adjusting various conditions, e.g., temperature, gas flow rate, and the like when forming the insulating protective film 100, it is possible to form the insulating protective film 100 having desired characteristics, e.g., film density, Young's modulus, and the like in a relatively easy manner.

In FIGS. 2 and 3, an upper-electrode lead electrode 90 formed, for example, of gold (Au) is connected to the upper electrode film 80 which constitutes the respective piezoelectric elements 300. The connection is achieved via a connection hole 101*a* which is formed in the insulating protective film 100.

On the flow path forming substrate 10 where the piezoelectric elements 300 are formed, the bonding substrate 30 on which the driving IC 120 for driving the piezoelectric elements 300 is mounted is bonded by means of an adhesive 39.

The bonding substrate 30 has piezoelectric element holding portions 31 capable of sealing a space which is secured in a region of the bonding substrate 30 opposed to the piezoelectric elements 300 in a state in which the movement of the piezoelectric elements 300 is not inhibited. The piezoelectric element holding portions 31 are provided so as to correspond to the rows 13 of the pressure generating chambers 12.

In the present embodiment, although the piezoelectric element holding portions 31 are integrally provided in regions corresponding to the rows 13 of the pressure generating chambers 12, they may be independently provided for each of the piezoelectric elements 300.

The material for the bonding substrate 30 is, for example, glass, a ceramic material, a metal, or a resin. Preferably, the bonding substrate 30 is formed of a material having approximately the same thermal expansion coefficient as that of the flow path forming substrate 10. In the present embodiment, the bonding substrate 30 is formed using a single crystal silicon substrate which is formed of the same material as that of the flow path forming substrate 10.

Moreover, in the bonding substrate 30, a reservoir portion 32 is formed in a region of the flow path forming substrate 10 corresponding to the ink supply path 14. In the present embodiment, the reservoir portion 32 is provided along the row 13 of the pressure generating chambers 12 so as to penetrate through the bonding substrate 30 in a thickness direction thereof. The reservoir portion 32 is communicated with the ink supply path 14 of the flow path forming substrate 10, thereby constituting a reservoir 110 which serves as a common ink chamber for the respective pressure generating chambers 12.

On the bonding substrate 30, a wiring pattern is provided so that a non-illustrated external wiring is connected thereto and driving signals are supplied thereto. On the wiring pattern, the driving ICs 120 which are semiconductor integrated circuits (ICs) for driving the respective piezoelectric elements 300 are mounted.

The driving signals include driving-related signals for driving the driving ICs such as driving power signals and various control-related signals such as serial signals (SI) and the wiring pattern is configured by a plurality of wirings to which respective signals are supplied.

The lower electrode film 60 is formed within a region opposed to the pressure generating chambers 12 in the longitudinal direction of the pressure generating chambers 12 so that it is continuously formed in regions corresponding to the plurality of pressure generating chambers 12. The lower electrode film 60 is provided so as to be extended to the outside of the row 13 of the pressure generating chambers 12.

The connection hole 101*b* for connecting the lower-electrode lead electrode 95 and the lower electrode film 60 is formed at the outside of the row 13 of the piezoelectric elements 300. Therefore, at least the pattern region of the layers constituting the piezoelectric elements 300 is completely covered with the insulating protective film 100, except the connection holes 101*a* and 101*b*.

The upper-electrode lead electrode 90 is connected to the vicinity of one end portion of the upper electrode film 80. Moreover, the driving IC 120 and the upper-electrode lead electrode 90 formed to be extended from the piezoelectric elements 300 are electrically connected by the connection wiring 130 configured by a conductive wire such as a bonding wire. Furthermore, the driving IC 120 and the lower-electrode lead electrode 95 are electrically connected by a non-illustrated connection wiring.

Furthermore, a compliance plate 40, which consists of a sealing film 41 and a fixing plate 42, is bonded onto the bonding substrate 30. Here, the sealing film 41 is formed of a material having a low rigidity and flexibility (for example, a polyphenylene sulfide (PPS) film having a thickness of 6 μm), and the sealing film 41 seals one surface of the reservoir portion 32. The fixing plate 42 is formed of a hard material such as a metal (for example, stainless steel (SUS) having a thickness of 30 μm). A region of the fixing plate 42 opposed to the reservoir 110 defines an opening portion 43 which is completely deprived of the plate in the thickness direction. Thus, one surface of the reservoir 110 is sealed only with the sealing film 41 having flexibility.

According to the embodiment described above, the following advantages can be provided.

(1) The groove 500 is formed so as to surround the piezoelectric elements 300 until it reaches the interface of the elastic film 50 and the insulation film 55. Since the insulating protective film 100 is formed in the groove 500, the insulating protective film 100 is formed so as to cover the interface of the elastic film 50 and the insulation film 55. Therefore, moisture moving toward the piezoelectric elements 300 from an outside of the groove 500 through the interface of the elastic film 50 and the insulation film 55 can be blocked by the insulating protective film 100, decreasing the possibility of the elastic film 50 and the insulation film 55 as the vibration plate to be destroyed by the moisture entering into the interface of the elastic film 50 and the insulation film 55 where the piezoelectric elements 300 are formed, whereby it is possible to obtain the ink jet recording head 1 and the ink jet recording apparatus 1000 having high reliability.

(2) Although the piezoelectric elements 300 are supported by the elastic film 50 and the insulation film 55 with respect to the pressure generating chambers 12, the groove 500 is formed in the elastic film 50 and the insulation film 55 so as not to interfere with the pressure generating chambers 12. Therefore, the possibility of the elastic film 50 and the insulation film 55 to be destroyed from the narrowed portion because of the groove 500 formed therein decreases and it is thus possible to obtain the ink jet recording head 1 and the ink jet recording apparatus 1000 having high reliability.

Second Embodiment

Figure 5:
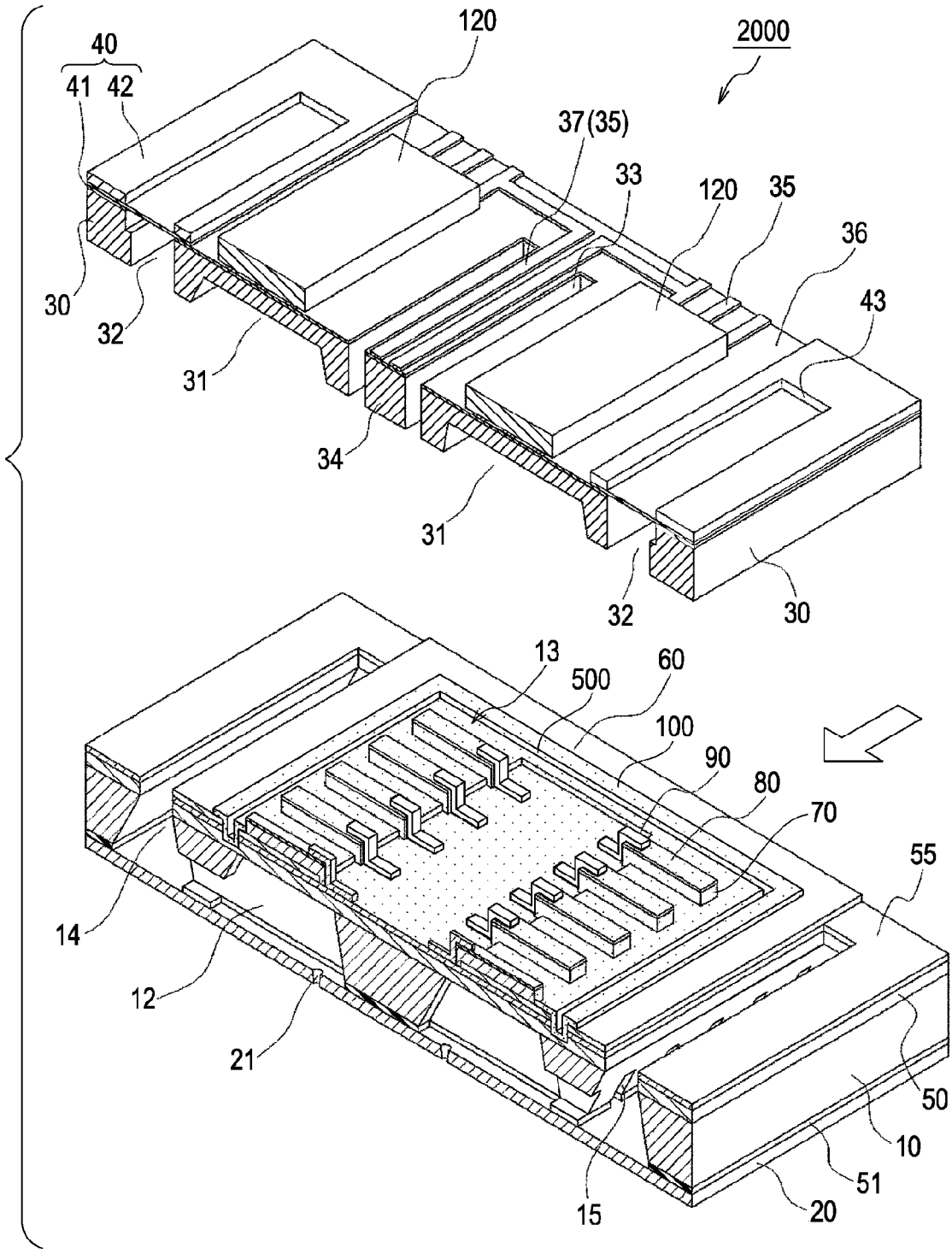
FIG. 5 is a partially exploded perspective view of an ink jet recording head according to a second embodiment.

Referring to FIG. 5, a partially exploded perspective view of an ink jet recording head 2000 according to the present embodiment is shown. The ink jet recording head 1 has an approximately rectangular shape, and FIG. 5 is a partially exploded perspective view of the ink jet recording head 2000, cut along planes perpendicular to a longitudinal direction thereof (the direction of an outlined arrow in the drawing).

Figure 6:
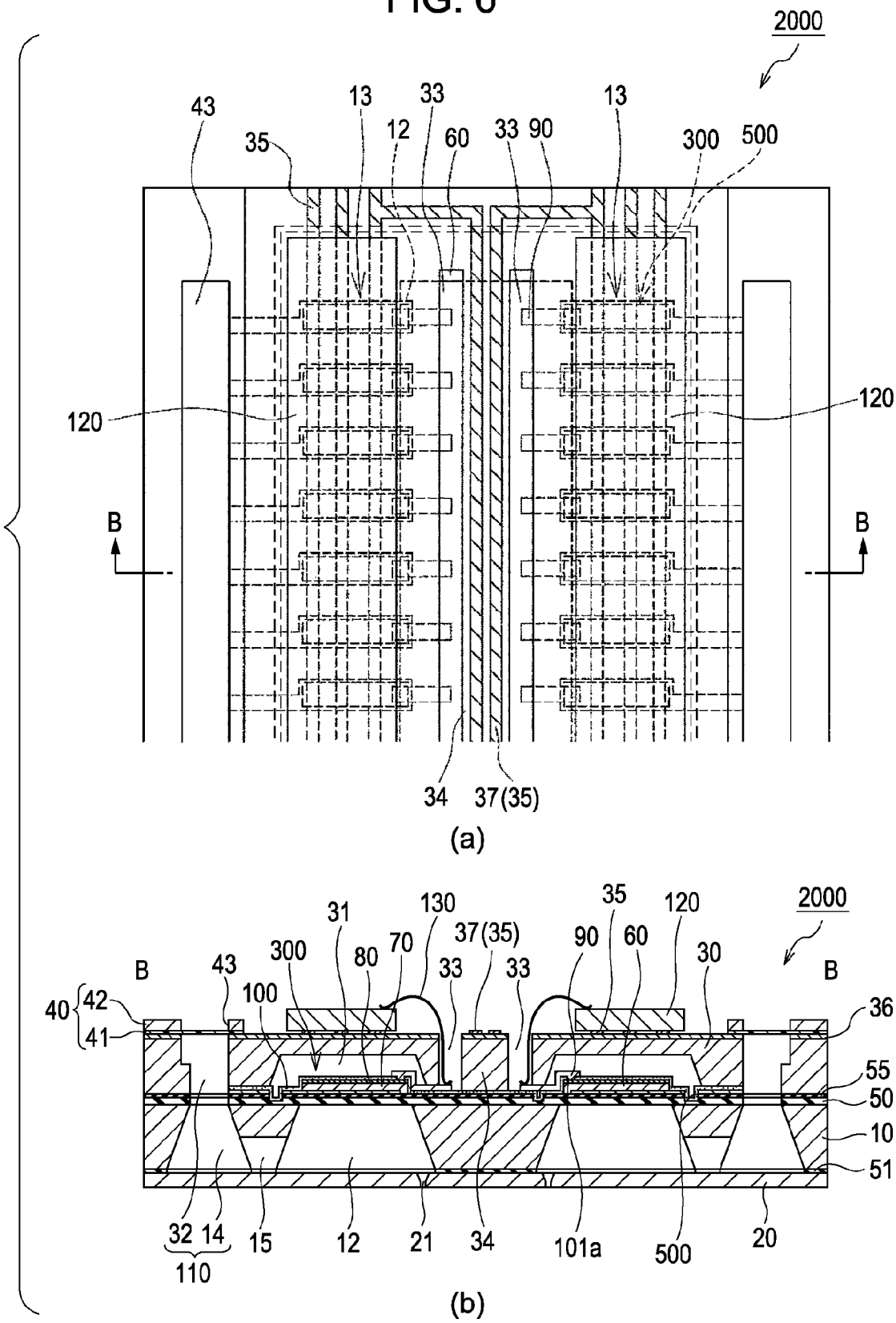
FIG. 6A is a partial top plan view of the ink jet recording head.
FIG. 6B is a B-B sectional view thereof.

FIG. 6A is a partial top plan view of the ink jet recording head 2000, and FIG. 6B is a B-B sectional view thereof. The members and portions having the same functions as those of the first embodiment will be denoted by the same reference numerals. The same members will be denoted by the same reference numerals, and redundant descriptions thereof will be omitted.

The present embodiment is different from the first embodiment, in that the members, portions, and the like of the ink jet recording head 1 according to the first embodiment are arranged in the width direction (direction perpendicular to the outlined arrow in FIG. 5) of the ink jet recording head 1.

Specifically, The pressure generating chambers 12 are symmetrically arranged in two rows 13 so that the upper-electrode lead electrode 90 of the ink jet recording head 1 of the first embodiment is disposed at an inside thereof. The upper-electrode lead electrode 90 is provided to be extended to a region located between the rows 13 of the pressure generating chambers 12.

In the approximately central portion of the bonding substrate 30, that is, in a region opposed to a zone located between the rows 13 of the pressure generating chambers 12, one through-hole 33 penetrating through the bonding substrate 30 in the thickness direction thereof is provided for each of the rows 13 of the pressure generating chambers 12, and a cantilever portion 34 is formed between the through-holes 33. The upper-electrode lead electrode 90 has a distal end of the extended portion thereof being exposed to the inside of the through-hole 33.

Further, although it is preferred that the cantilever portion 34 is formed to be integral with the bonding substrate 30, the cantilever portion 34 may be configured to be independent from the bonding substrate 30.

On the bonding substrate 30, a wiring pattern 35 is provided via an insulating protective film 36 so that a non-illustrated external wiring is connected thereto and driving signals are supplied thereto. On both sides of the through-hole 33 of the bonding substrate 30, that is, on the wiring pattern 35 at regions corresponding to the rows 13 of the pressure generating chambers 12, the driving ICs 120 which are semiconductor integrated circuits (ICs) for driving the respective piezoelectric elements 300 are mounted.

Moreover, the driving ICs 120 mounted on the wiring pattern 35 and the upper-electrode lead electrode 90 formed to be extended from the piezoelectric elements 300 are electrically connected by the connection wiring 130 which is extended to the inside of the through-hole 33 of the bonding substrate 30 and is configured by a conductive wire such as a bonding wire. Similarly, the common electrode wiring 37 of the wiring pattern 35 and the lower electrode film 60 are electrically connected to each other at the vicinity of both end portions of the through-hole 33 by a non-illustrated connection wiring.

The piezoelectric element holding portions 31 are provided so as to correspond to the rows 13 of the pressure generating chambers 12. Moreover, in the present embodiment, the common electrode wiring 37 which is connected to the lower electrode film 60 which is the common electrode of the piezoelectric elements 300 among the wirings constituting the wiring pattern 35 and to which the driving signals (COM) are supplied is provided on the cantilever portion 34 together with the region having the driving IC 120 mounted thereon so as to extend along the row 13 of the pressure generating chambers 12. The wiring provided on the cantilever portion 34 is not limited to the common electrode wiring 37 but a wiring for supplying serial signals or the like may be provided.

(Modification)

Figure 7:
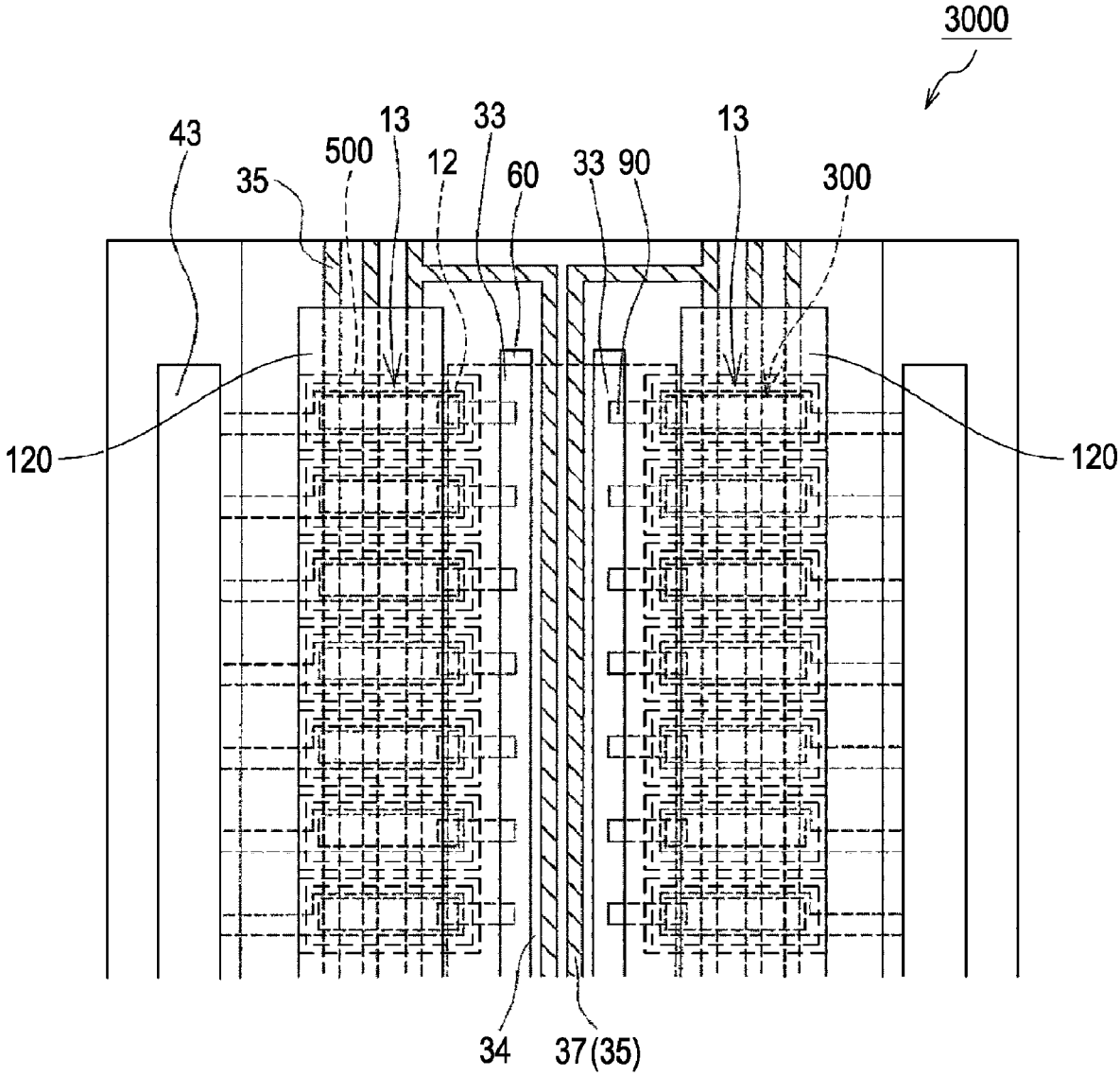
FIG. 7 is a top plan view of an ink jet recording head according to a modification.

FIG. 7 is a top plan view of an ink jet recording head 3000 according to a modification. This modification is an example in which a groove 500 is provided so as to surround the piezoelectric elements 300 in the second embodiment.

Besides the modification, various changes may be made to the embodiments.

For example, in the above-described embodiments, although the bonding substrate 30 having the piezoelectric element holding portions 31 is illustrated as the bonding substrate, the bonding substrate is not particularly limited as long as it is a substrate on which the driving IC is mounted.

The driving signals include driving-related signals for driving the driving ICs such as driving power signals and various control-related signals such as serial signals (SI) and the wiring pattern 35 is configured by a plurality of wirings to which respective signals are supplied. Moreover, in the second embodiment, the common electrode wiring 37 which is connected to the lower electrode film 60 which is the common electrode of the piezoelectric elements 300 among the wirings constituting the wiring pattern 35 and to which the driving signals (COM) are supplied is provided on the cantilever portion 34 together with the region having the driving IC 120 mounted thereon so as to extend along the row 13 of the pressure generating chambers 12. The wiring provided on the cantilever portion 34 is not limited to the common electrode wiring 37 but a wiring for supplying serial signals or the like may be provided.

While the embodiments of the present invention have been described, the present invention is not limited to the embodiments and the modification described above.

For example, in the above-described embodiments, although the piezoelectric elements 300 are formed within the piezoelectric element holding portions 31 of the bonding substrate 30, the present invention is not limited to this but the piezoelectric elements 300 may be exposed. In this case, since the surfaces of the piezoelectric elements 300, the upper-electrode lead electrode 90, and the like are covered with the insulating protective film 100 formed of the inorganic insulating material, destruction of the piezoelectric layer 70 resulting from moisture (dampness) is certainly prevented.

Moreover, although in the above-described embodiments, the ink jet recording head has been described as an example of the liquid jet head of the present invention, the basis configuration of the liquid jet head is not limited to those described above. The present invention is aimed to broadly cover the overall liquid jet head and is also applicable to a liquid jet head ejecting liquid other than ink. Examples of other liquid jet heads include a variety of type of recording heads for use in an image recording apparatus such as a printer, a coloring-material jet head for use in manufacture of a color filter of a liquid crystal display or the like, an electrode-material jet head for use in forming an electrode of an organic EL display, an FED (field emission display) or the like, a bioorganic-material jet head for use in manufacture of a biochip, and the like.

What is claimed is:

1. A liquid jet head comprising: a flow path forming substrate having formed therein a row of pressure generating chambers, each of which is communicated with a nozzle opening; a piezoelectric element which is provided in each of the pressure generating chambers via a vibration plate formed of a plurality of layers; and a bonding substrate which is bonded to a piezoelectric element forming side of the flow path forming substrate, wherein a groove is formed in a region of the vibration plate, the groove surrounding on at least two sides the piezoelectric element so as to extend to an interface of the plurality of layers or extend over the interface, wherein an insulator formed of an inorganic insulating material is formed in the groove.

2. The liquid jet head according to claim 1, wherein the groove is formed in a region of the vibration plate surrounding the pressure generating chambers.

3. The liquid jet head according to claim 1, wherein the inorganic insulating material comprises aluminum oxide.

4. The liquid jet head according to claim 1, wherein the vibration plate comprises two layers, one layer of the two layers comprising silicon oxide and the other layer comprising zirconium oxide.

5. A liquid jet apparatus comprising the liquid jet head according to claim 1.

* * * * *